United States Patent [19]

Burgoon

[11] 4,115,890

[45] Sep. 26, 1978

[54] HIGH-SPEED POLISHING MACHINE

[75] Inventor: Jack L. Burgoon, Toledo, Ohio

[73] Assignee: The Scott & Fetzer Company, Lakewood, Ohio

[21] Appl. No.: 790,396

[22] Filed: Apr. 25, 1977

[51] Int. Cl.[2] ..... A47L 11/162

[52] U.S. Cl. ..... 15/49 R; 15/143 A; 51/177; 280/43.22; 280/47.37 R

[58] Field of Search ..... 15/49 R, 49 C, 50 R, 15/50 C, 51, 52, 49 RB, 50 A, 98, 143 A, 385; 51/177; 280/43.22, 47.37

[56] References Cited

U.S. PATENT DOCUMENTS

| | | | |
|---|---|---|---|
| 1,060,041 | 4/1913 | Wagner | 15/49 C X |
| 1,694,738 | 12/1928 | Geary | 15/49 R |
| 2,079,946 | 5/1937 | Myers | 15/49 R |
| 2,541,812 | 2/1951 | Finnell | 15/50 R |
| 3,921,244 | 11/1975 | Warren et al. | 15/98 |

FOREIGN PATENT DOCUMENTS

| | | | |
|---|---|---|---|
| 2,036,935 | 12/1970 | France | 15/49 R |
| 1,094,945 | 12/1960 | Fed. Rep. of Germany | 15/49 R |
| 455,132 | 10/1936 | United Kingdom | 15/49 R |
| 687,107 | 2/1953 | United Kingdom | 15/49 R |

*Primary Examiner*—Edward L. Roberts
*Attorney, Agent, or Firm*—Allen D. Gutchess, Jr.

[57] ABSTRACT

A high-speed polishing machine is provided which has a polishing pad rotatable at speeds substantially in excess of those heretofore usually employed for polishing machines. The new polishing machine is designed to operate at speeds in excess of 1,000 rpm and preferably about 1,150 rpm. Motors capable of rotating the polishing pads at such speeds operate close to the limits of 110 volt power and if excess pressure is placed on the pad, it will slow down substantially and frequently cause the motor to stall. The new machine has rear wheels which partially support the weight of the machine and has means for raising and lowering the wheels so as to control the pressure on the polishing pad. The machine also has a handle with a latch which enables the handle to raise the front of the machine when it is to be transported and the handle is in an upright, transporting, position. However, the latch will not enable the handle to place additional pressure on the rotating pad when the machine is operating and the handle is in a slanted, operating position.

5 Claims, 6 Drawing Figures

HIGH-SPEED POLISHING MACHINE

This invention relates to a high-speed polishing machine.

High-speed polishing machines, operating at speeds in excess of 1,000 rpm, provide a better shine for a floor surface and particularly for surfaces which are hard to shine much more effectively than conventional, low-speed machines. Heretofore, to a limited extent, some machines have been operated by propane-powered internal combustion engines in order to achieve sufficient power for the high speed. With electric motors, a 220 volt power source was required which was unavailable in most residences and in many commercial establishments.

It has been found that a high-speed polishing machine can employ an electric motor powered by a 110 volt power source if the pressure on the polishing pad or brush is carefully controlled and limited. Under such circumstances, the polishing pad can be operated as high as about 1,150 rpm.

In accordance with the invention, a high-speed polishing machine includes a platform or frame having wheels mounted on the rear thereof with a pad driver housing or shroud located at the opposite end and with an electric motor positioned therebetween so that its weight is not directly on the brush but is partly carried by the wheels. The wheels, in turn, are provided with means for adjustably raising and lowering them which affects the pressure on the rotating pad and the load or tongue on the motor. In addition, the handle of the new polishing machine is equipped with a latch which cooperates with the platform when the handle is in an upright position to enable the handle to be tilted back to raise the platform and the pad driver for transportation purposes. However, when the handle is in a rear, slanted position and the pad is rotating, the handle cannot be raised to apply additional pressure through the platform on the pad, which could otherwise cause the motor to stall or slow down excessively.

It is, therefore, a principal object of the invention to provide a high-speed floor polishing machine driven by an electric motor with wheels to partially support the weight of the machine.

Another object of the invention is to provide a high-speed polishing machine with a platform, wheels at one end portion of the platform, a pad housing at the other end portion and a motor therebetween, with means for raising and lowering the wheels to change the pressure of the pad on the surface.

Still another object of the invention is to provide an improved floor polishing machine operated by an electric motor, and having a handle which is freely pivotable relative to the machine when in a rear, slanted position and the polishing pad is rotating.

Many other objects and advantages of the invention will be apparent from the following detailed description of a preferred embodiment thereof, reference being made to the accompanying drawings, in which.

Figure 1:
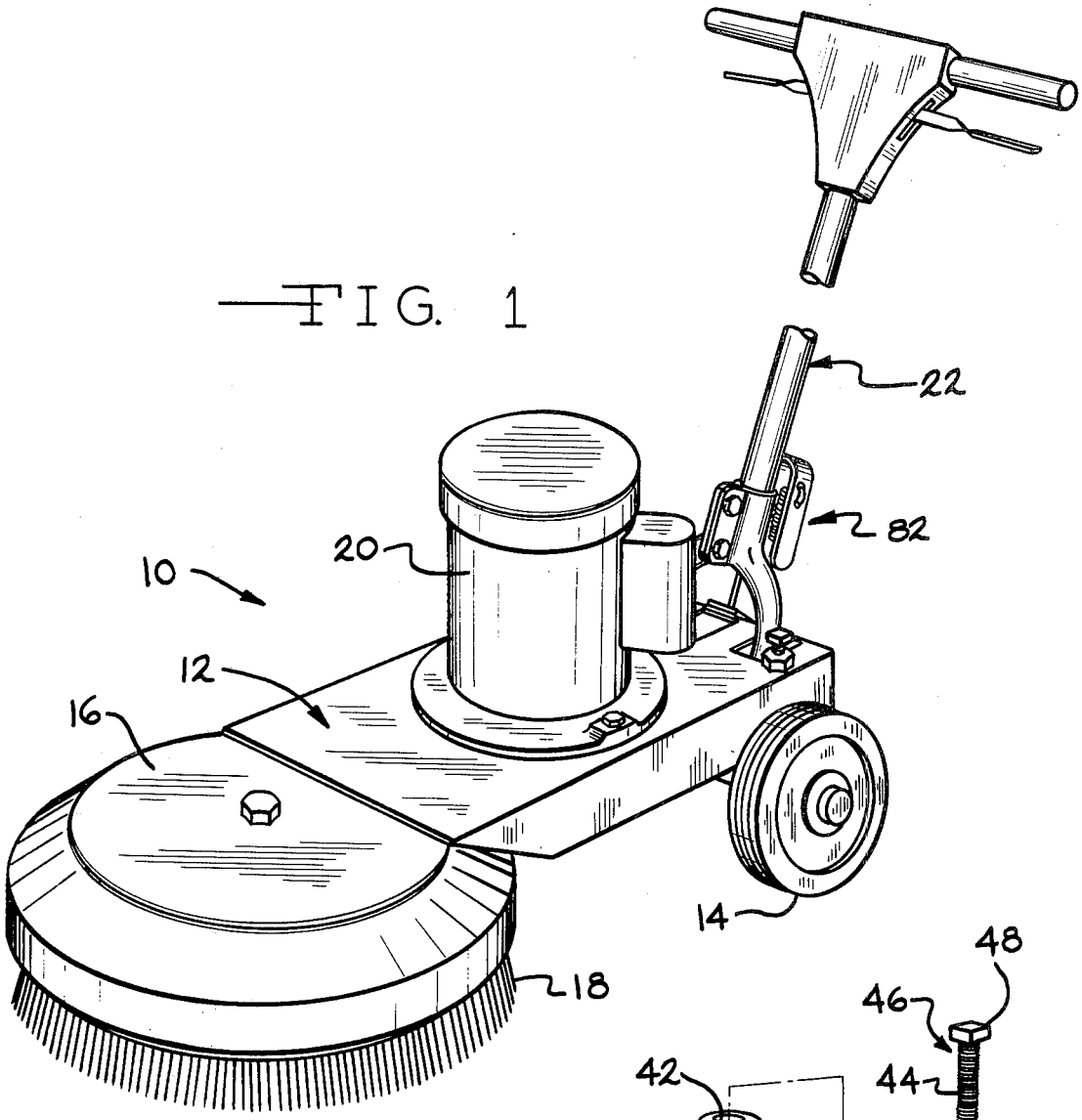
FIG. 1 is a view in perspective of a high-speed floor polishing machine embodying the invention.
Figure 2:
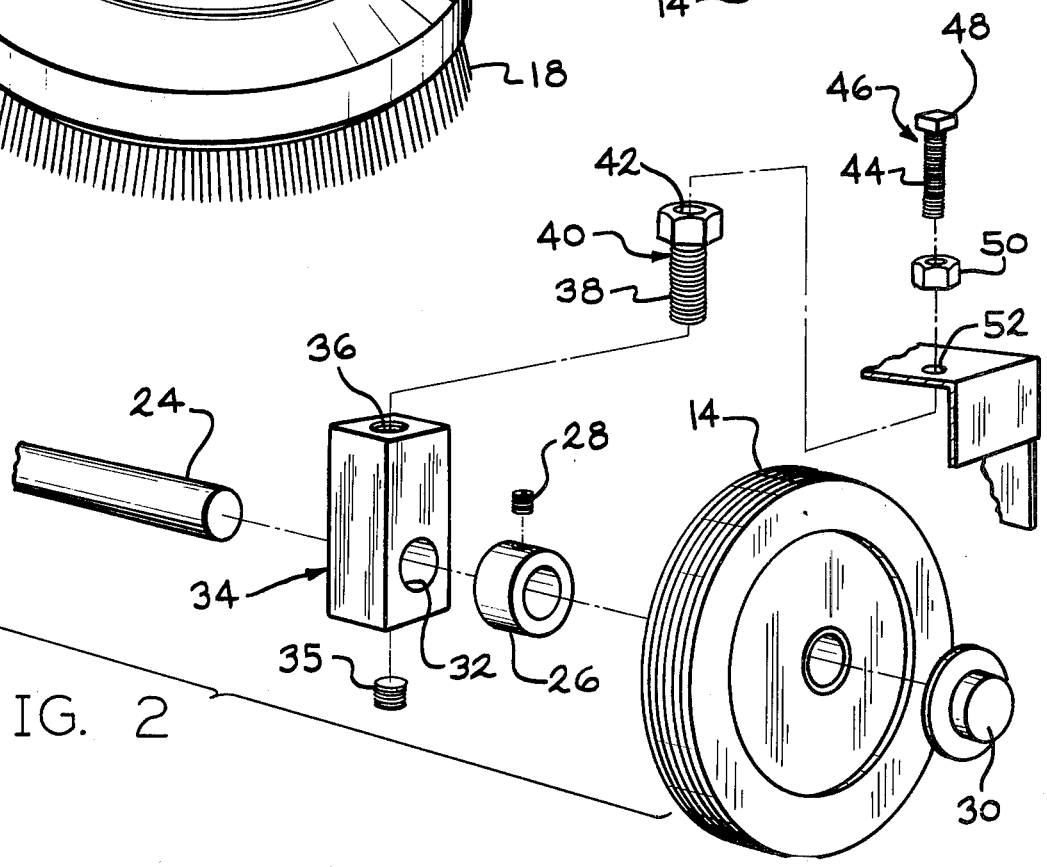
FIG. 2 is a detailed, exploded view of means for raising and lowering the wheels of the floor polishing machine.

Referring to the drawings, and particularly to FIG. 1, a high-speed polishing machine according to the invention is indicated at 10. The machine basically includes a frame or platform 12, rear wheels 14, a forward housing or shroud 16, a polishing pad driver 18, a motor 20, and a handle 22. The pad driver 18 includes a backing disc and bristles as is known in the art and is used to rotate a polishing pad placed under the driver. The driver, in turn, is rotated through a suitable sheave and V-belt under the shroud and platform and connected with a drive sheave of the motor 20.

The driver 18 is rotated at relatively high speeds, in excess of 1,000 rpm and preferably about 1,150 rpm. At these speeds, a more highly polished surface can be obtained, even on some floors having relatively rough surfaces which are hard to shine. However, at such speeds, with a 110 volt power source, maximum power will be used and any extra load or pressure on the driver 18 will cause it to slow down sharply.

The wheels 14 can be raised or lowered somewhat to change the load on the motor 20. With the wheels 14 and the platform 12 lower, pressure is concentrated at the back of the pad driver 18 and the load on the motor 20 tends to be increased. With the wheels 14 and the platform 12 higher, there is less torque or load on the motor with more pressure at the front of the driver 18, but the handle 22 of the polisher tends to whip more and is somewhat harder to manipulate.

The wheels 14 are located on an axle 24 and each is positioned between a locking collar 26 with a setscrew 28 and an outer push nut or hub 30 on the end of the axle. The axle extends through holes 32 in adjusting blocks 34 and held in position by setscrews 35. Each of the blocks or members 34 has a threaded bore 36 extending longitudinally thereof from the upper end. A threaded shank 38 of a lower adjusting member 40 is threadably engaged in the bore 36 with the adjusting member 40, in turn, having a smaller threaded bore 42 extending longitudinally thereof from the upper end. The bore 42 receives a threaded shank 44 of an upper adjusting member 46 having noncircular, square head 48 at the upper end. The threaded shank 44 extends through a locking or jam nut 50 and an opening 52 in the platform 12 and is received in the bore 42. The upper adjusting member 46 is affixed to the lower adjusting member 40, either by suitable adhesive in the bore 42 or by a force fit between the shank 44 and the bore 42, so that the two always turn together.

With this arrangement, when the upper adjusting member 46 is turned through the square head 48, the lower adjusting member 40 is also turned so as to extend more fully or less fully into the bore 36 of the adjusting block 34. This causes the block 34 to be moved closer to or further away from the platform 12 and, accordingly, raises or lowers the axle 24 and the wheels 14. When the wheels are in the desired position, the locking nut 50 is turned downwardly against the platform 12 to prevent accidental turning of the adjusting members 46 and 40. The height of the adjusting block 34 and the adjusting members 40 and 46 will then remain fixed, with the top of the adjusting member 40 in contact with the lower surface of the platform 12 and with the adjusting nut 50 in contact with the upper surface of the platform 12.

Figure 3:
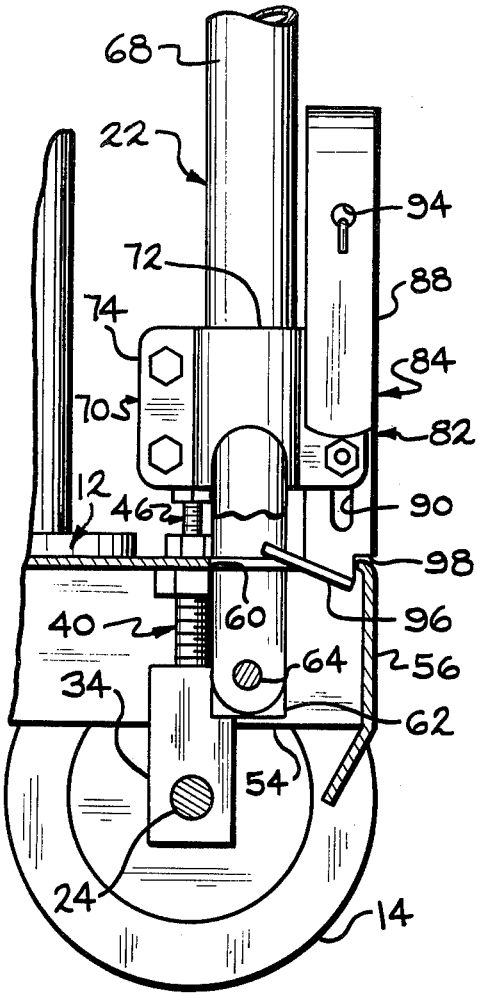
FIG. 3 is a fragmentary view in elevation, with parts broken away and with parts in section, of the machine with a handle and a latch embodying the invention.
Figure 4:
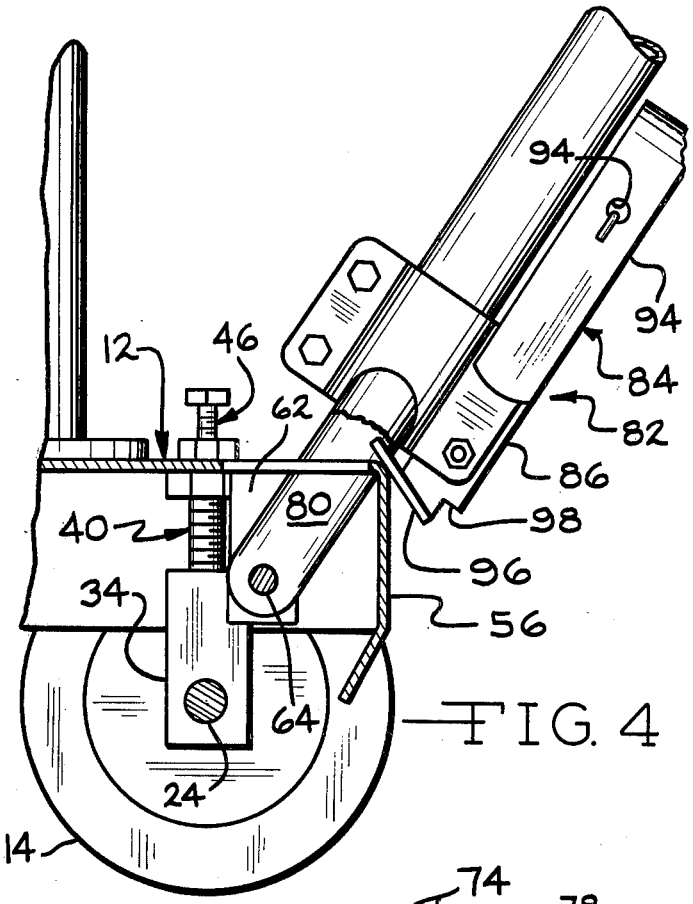
FIG. 4 is a view similar to FIG. 3 with the handle and the latch in a different position.
Figure 5:
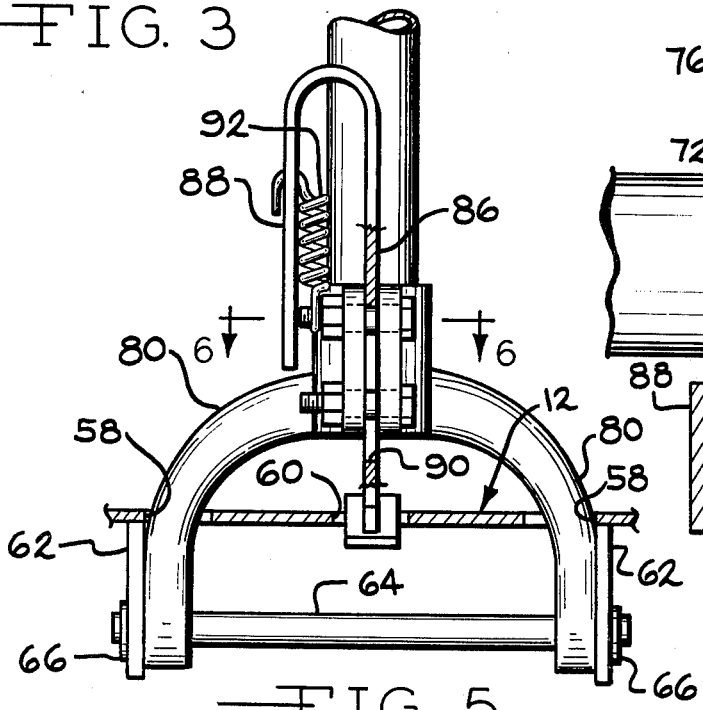
FIG. 5 is a rear view in elevation of the handle and latch of FIG. 3, with parts broken away and with parts in section.
Figure 6:
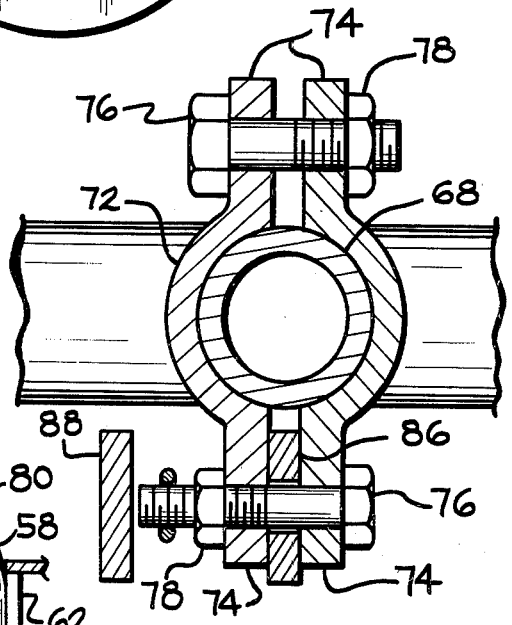
FIG. 6 is an enlarged, detailed view in transverse cross section taken along the line 6—6 of FIG. 5.

Referring more particularly to FIGS. 3–5, the platform 12 has side stiffening flanges 54 tapering at the forward end where the platform is affixed to the shroud 16. The platform 12 also has a rear flange 56 extending downwardly therefrom and turned inwardly at the lower end. Adjacent the rear flange 56, the platform has two side rectangular openings 58 therein and a central rectangular opening 60. Two ears 62 are affixed to the platform and extend downwardly therefrom near the openings 58 to receive an axle 64 held by locking rings 66.

The handle 22 includes a main post 68 with a yoke 70 affixed to the lower end thereof. The yoke 70 has a hub 72 with flanges 74 connected by bolts 76 and nuts 78 to the lower end of the post 68. A pair of diverging arms 80 extend downwardly from the hub 72, extending through the openings 58 in the platform 12 and pivotally received on the axle 64.

When the handle is in its rear, slanted, operating position, the arms 80 of the yoke 70 abut the rear edges of the openings 58 adjacent the rear flange 56. In such an instance, further downward pressure on the handle 22 can reduce the pressure of the pad driver 18 on the pad against the floor. However, if the handle 22 is moved upwardly, it will not apply increased pressure on the pad driver 18 since the yoke 70 will simply pivot upwardly from the rear, slanted position of FIG. 4 toward the upright position of FIG. 3. With the handle 22 upright, however, it can be moved downward and rearwardly so that pressure on the handle 22 will raise the shroud 16 and the pad driver 18 to enable the machine 10 to be transported on the wheels 14.

To achieve these results, the handle 22 is equipped with a special latch 82. The latch 82 includes a U-shaped member 84 having a long leg 86 and a shorter leg 88. The long leg 86 has an elongate opening 90 therein which receives the shanks of the rear bolts 76 which connect the rear flanges 74 of the yoke 70. The leg 86 is slidably held between the flanges so that it can move vertically, being guided by the elongate opening 90 and the bolts 76. The member 84 is urged toward its downward position by a coil spring 92 having a lower end connected to one of the bolts and having an upper end received in a hole 94 in the short leg 88.

A cam plate 96 is affixed to the lower end of the longer 86 adjacent a notch 98 in the lower end of the leg. With the handle 22 and the latch 82 in the upright position of FIG. 3, the cam plate 96 extends into the central opening 60 of the platform 12 with the edge of the notch 98 abutting the upper edge of the rear flange 56. When the handle 22 is rotated downwardly and rearwardly, in a clockwise direction as shown in FIG. 3, the leg 86 of the U-shaped member 84 bears against the platform and enables the shroud 16 and the pad driver 18 to be raised so that the machine can be moved about on its wheels 14. However, when the U-shaped member 84 is raised, to move the notch 98 and the cam plate 96 above the opening 60 of the platform 12, the handle can then be moved clockwise without moving the platform 12 until the arms 80 of the yoke 70 abut the rear edges of the openings 58. At this time, the cam plate 96 merely rides upon the upper edge of the rear flange 56 of the platform so that any attempt to move the handle 22 in a counterclockwise direction simply moves it back toward the upright position of FIG. 3 with no further pressure whatsoever being placed upon the pad driver 18.

When the handle again is in the upright position, the spring 92 urges the cam plate 96 into the opening 60 once again with the edge of the notch 98 abutting the rear flange 56. Hence, the latch 82 need only be manipulated when it is desired to move the handle 22 from the upright, transporting position to the slanted, operating position.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. A polishing machine comprising a platform, wheels at a rear portion of said platform for supporting the platform above the floor, a housing at a forward portion of said platform, a rotatable pad driver rotatably supported by said housing, a motor mounted on an intermediate portion of said platform between said housing and said wheels for rotating said driver, a handle pivotally mounted on a rear portion of said machine, said wheels having an axle extending transversely of said machine under said platform, at least two spaced adjusting members under said platform and having transverse holes receiving said axle, said members having threaded bores therein, threaded shanks received in said bores, said threaded shanks having smaller threaded bores, and bolt means extending through openings in said platform and threadedly engaged in said smaller threaded bores of said threaded shanks, said threaded shanks raising and lowering said spaced adjusting members with respect to said platform to raise and lower said wheels when said threaded shanks are turned into and out of said adjusting members.

2. A polishing machine according to claim 1 characterized by said threaded shanks having upper heads thereon, and adjusting nuts on said bolt means and turnable thereon to engage the upper surface of said platform with the heads engaging the lower surface of said platform to prevent turning of said threaded shanks and said bolt means.

3. A high-speed polishing machine comprising a platform, wheel means below a portion of said platform for supporting the platform above the floor, a housing at a forward portion of said platform, a rotatable pad driver rotatably supported by said housing, a motor mounted on an intermediate portion of said platform for rotating said driver, a handle having a yoke pivotally mounted on a rear portion of said machine, a latch movably carried by said handle for movement toward and away from said platform, said platform having a portion engagable by said ltach when said handle is in an upright position to cause downward pivotal movement of said handle to raise said platform, said yoke engaging said platform portion when said handle is in a rear, slanted position, whereby further rearward movement of said handle will tilt said platform back on said wheel means, resilient means urging said latch toward said platform portion, and said latch having another position enabling free upward pivotal movement of said handle when said handle is in the rear, slanted position.

4. A high-speed polishing machine according to claim 1 characterized by said latch comprising a member having a notch at an end thereof, a cam plate affixed to the notched end of said member, said notch being engageable with said platform portion when said handle is in the upright position and said cam plate being engageable with said platform portion when said handle is in the slanted position.

5. A polishing machine comprising a platform, wheels at a rear portion of said platform for supporting the platform above the floor, a housing at a forward portion of said platform, a rotatable pad driver rotatably supported by said housing, a motor mounted on an intermediate portion of said platform between said housing and said wheels for rotating said driver, a handle pivotally mounted on a rear portion of said machine, said wheels having an axle extending transversely of said machine under said platform, at least two spaced adjusting members under said platform and having transverse holes receiving said axle, said members having threaded bores therein, threaded shanks received in said bores, said threaded shanks having smaller threaded bores, bolt means extending through openings in said platform and threadedly engaged in said smaller threaded bores of said threaded shanks, said threaded shanks raising and lowering said spaced adjusting members with respect to said platform to raise and lower said wheels when said threaded shanks are turned into and out of said adjusting members, a latch movably carried by said handle for movement toward and away from said platform, said platform having a portion engagable by said latch when said handle is in an upright position to cause downward pivotal movement of said handle to raise said platform, said handle engaging said platform portion when said handle is in a rear, slanted position, whereby further rearward movement of said handle will tilt said platform back on said wheels, and said latch having another position enabling free upward pivotal movement of said handle when said handle is in the rear, slanted position.

* * * * *

UNITED STATES PATENT OFFICE

CERTIFICATE OF CORRECTION

PATENT NO. : 4,115,890

DATED : September 26, 1978

INVENTOR(S) : Jack L. Burgoon

It is certified that error appears in the above-identified patent and that said Letters Patent are hereby corrected as shown below:

Column 4, line 55, change "ltach" to -- latch --.

Column 4, line 66, change "l" to -- 3 --.

Signed and Sealed this

*Thirtieth* Day of *January 1979*

[SEAL]

*Attest:*

RUTH C. MASON
*Attesting Officer*

DONALD W. BANNER
*Commissioner of Patents and Trademarks*